US008551323B2

(12) United States Patent
Abdel-Halim et al.

(10) Patent No.: US 8,551,323 B2
(45) Date of Patent: Oct. 8, 2013

(54) SYSTEMS AND METHODS FOR HYDROPROCESSING A HEAVY OIL FEEDSTOCK

(75) Inventors: Tayseer A Abdel-Halim, Benicia, CA (US); Axel Brait, San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1073 days.

(21) Appl. No.: 12/551,015

(22) Filed: Aug. 31, 2009

(65) Prior Publication Data

US 2011/0049010 A1 Mar. 3, 2011

(51) Int. Cl.
*C10G 65/10* (2006.01)

(52) U.S. Cl.
USPC ..... 208/49; 208/57; 208/58; 208/59; 208/60; 208/61

(58) Field of Classification Search
USPC ..... 208/49, 57–61
See application file for complete search history.

(56) References Cited

U.S. PATENT DOCUMENTS

| | | | | |
|---|---|---|---|---|
| 4,485,004 | A * | 11/1984 | Fisher et al. | 208/107 |
| 4,737,267 | A | 4/1988 | Pao et al. | |
| 5,080,692 | A | 1/1992 | Lee et al. | |
| 5,096,567 | A | 3/1992 | Paspek et al. | |
| 5,496,464 | A | 3/1996 | Piskorz et al. | |
| 6,217,746 | B1 * | 4/2001 | Thakkar et al. | 208/59 |
| 6,887,813 | B2 | 5/2005 | Ginosar et al. | |
| 7,144,498 | B2 | 12/2006 | McCall et al. | |
| 2008/0210602 | A1 | 9/2008 | Duyvesteyn | |
| 2009/0139715 | A1 | 6/2009 | Choi | |
| 2010/0065473 | A1 * | 3/2010 | Chabot et al. | 208/57 |
| 2011/0017635 | A1 * | 1/2011 | Chabot et al. | 208/59 |

FOREIGN PATENT DOCUMENTS

WO WO2008/154576 12/2008

OTHER PUBLICATIONS

Fuel 80 (2001) pp. 1087-1099 "Upgrading of bitumen in supercritical fluids" by Scott et al.

Energy & Fuels (2007), 21, pp. 3490-3498, Upgrading of Athabasca Vacuum Tower Bottoms (VTB) in *Supercritical Hydrocarbon Solvents with Activated Catalysts*. Xu et al.

* cited by examiner

*Primary Examiner* — Brian McCaig

(57) ABSTRACT

Systems and methods for hydroprocessing a heavy oil feedstock are disclosed. The system employs a plurality of contacting zones and at least one separation zone, wherein a solvating hydrocarbon having a normal boiling point less than 538° C. (1000° F.) is employed. In the system, a mixture of heavy oil feedstock and solvating hydrocarbon is provided to a contact zone along with a slurry catalyst feed in a hydrocarbon diluent. The contacting zone operates at a temperature and pressure near the critical temperature and pressure of the heavy oil and solvating hydrocarbon mixture to convert at least a portion of the heavy oil feedstock to lower boiling hydrocarbons, forming upgraded products.

17 Claims, 4 Drawing Sheets

SYSTEMS AND METHODS FOR HYDROPROCESSING A HEAVY OIL FEEDSTOCK

CROSS-REFERENCE TO RELATED APPLICATIONS

NONE.

TECHNICAL FIELD

The invention relates generally to systems and methods for use in the conversion of heavy oil and residua.

BACKGROUND

The petroleum industry is increasingly turning to heavy crudes, resids, coals and tar sands as sources for feedstocks. Feedstocks derived from these heavy materials contain more sulfur and nitrogen than feedstocks derived from more conventional crude oils, requiring a considerable amount of upgrading in order to obtain usable products therefrom.

Bulk (unsupported) catalysts have recently been disclosed for use in the hydroconversion of heavy crudes. US Patent Publication No. 20070161505 discloses an ultra-dispersed catalyst composition having a median particle diameter between 30-6000 nm. US Patent Publication No. US2009023965 discloses a catalyst composition with an emulsion of an aqueous phase in an oil phase and wherein the aqueous phase comprises an aqueous solution containing a group 6 metal and a group 8, 9 or 10 metal. US Patent Publication No. US2005241993 discloses the upgrading of heavy oil using individual metal sulfide catalyst molecules and/or extremely small particles that are colloidal in size (i.e., less than 100 nm and preferably less than about 1 nm).

In the hydroconversion processes of the prior art as disclosed in US Patent Publication No. US2005241993, after the initial slurry phase reactor, the upgraded feedstock containing residual or molecular catalyst is further processed in another reactor in series, e.g., an ebullated bed reactor with the residual colloidal or molecule catalyst providing additional catalytic hydrogenation activity. The hydroconversion is carried out in a pilot plant at operating pressure ranging from 1500 to 2100 psi, and at a hydrocracking temperature ranging from 410° C. (770° F.) to 460° C. (860° F.). Underhigh pressure, high temperature hydrocracking conditions, solid deposits tend to form, plugging up equipment and cutting down operation time.

There is still a need for improved processes to upgrade heavy oil, particularly a heavy oil upgrade process that can operate at a lower pressure than specified in the prior art and/or with less solid build-up in the reactor system. There is also a need to slow down the deactivation of bulk catalysts for use in the upgrade of heavy oil.

SUMMARY OF THE INVENTION

In one aspect, this invention relates to a process for by which a heavy oil feedstock can be upgraded. The process employs a plurality of contacting zones and at least a separation zone, and wherein a solvating hydrocarbon is employed to improve the transport properties in the system. The process comprising: providing a mixture of a heavy oil feedstock with the solvating hydrocarbon with the mixture having a critical temperature $T_c$ in the range of 500° F. to 1000° F. and a critical pressure $P_c$ in the range of 500 psi to 2000 psi; providing a hydrogen containing gas feed; providing a slurry catalyst feed in a hydrocarbon oil diluent; combining the hydrogen containing gas feed, the mixture of heavy oil feedstock and the solvating hydrocarbon, and the slurry catalyst feed in a first contacting zone at a temperature near $T_c$ and a pressure near $P_c$ to convert at least a portion of the heavy oil feedstock to lower boiling hydrocarbons, forming upgraded product; sending an effluent mixture comprising the upgraded products, the slurry catalyst, hydrogen-containing gas, the solvating hydrocarbon, and unconverted heavy oil feedstock to a separation zone, whereby the upgraded products are removed with hydrogen and the solvating hydrocarbon as an overhead stream; and the slurry catalyst and the unconverted heavy oil feedstock are removed as a non-volatile stream.

In another aspect, the process employs a plurality of contacting zones operating in a sequential mode, wherein the effluent from the first contacting zone is sent to a second contacting zone along with additional hydrogen containing gas, optional additional slurry catalyst feed, additional solvating hydrocarbon and hydrocarbon feedstock for further upgrade.

In yet another aspect, the process employs a plurality of contacting zones operating in a sequential mode, wherein the effluent from the first contacting zone is sent to a second contacting zone with additional hydrogen containing gas for unconverted heavy oil feedstock is further upgraded.

In a fourth aspect, the process employs a plurality of contacting zones operating in parallel mode, further comprising providing at least a portion of hydrogen containing gas feed, at least a portion of the mixture of heavy oil feedstock and solvating hydrocarbon, and at least a portion of the slurry catalyst feed to a second contacting zone, with the contacting zone also operating at a temperature and a pressure around $T_c$ and $P_c$, converting at least a portion of the heavy oil feedstock to lower boiling hydrocarbons, forming additional upgraded products;

BRIEF DESCRIPTION OF THE DRAWING

FIG. 2 is a block diagram schematically illustrating a system for upgrading heavy oil feedstock under once-through conditions where the majority of hydrocarbons is at near critical conditions (around critical point), with two contacting zones in series and each with a separator in between.

FIG. 2 is a block diagram schematically illustrating a system for upgrading heavy oil feedstock under once-through conditions where the majority of hydrocarbons is at near critical conditions (around critical point), with two contacting zones in series and sharing a separator.

DETAILED DESCRIPTION

Figure 1:
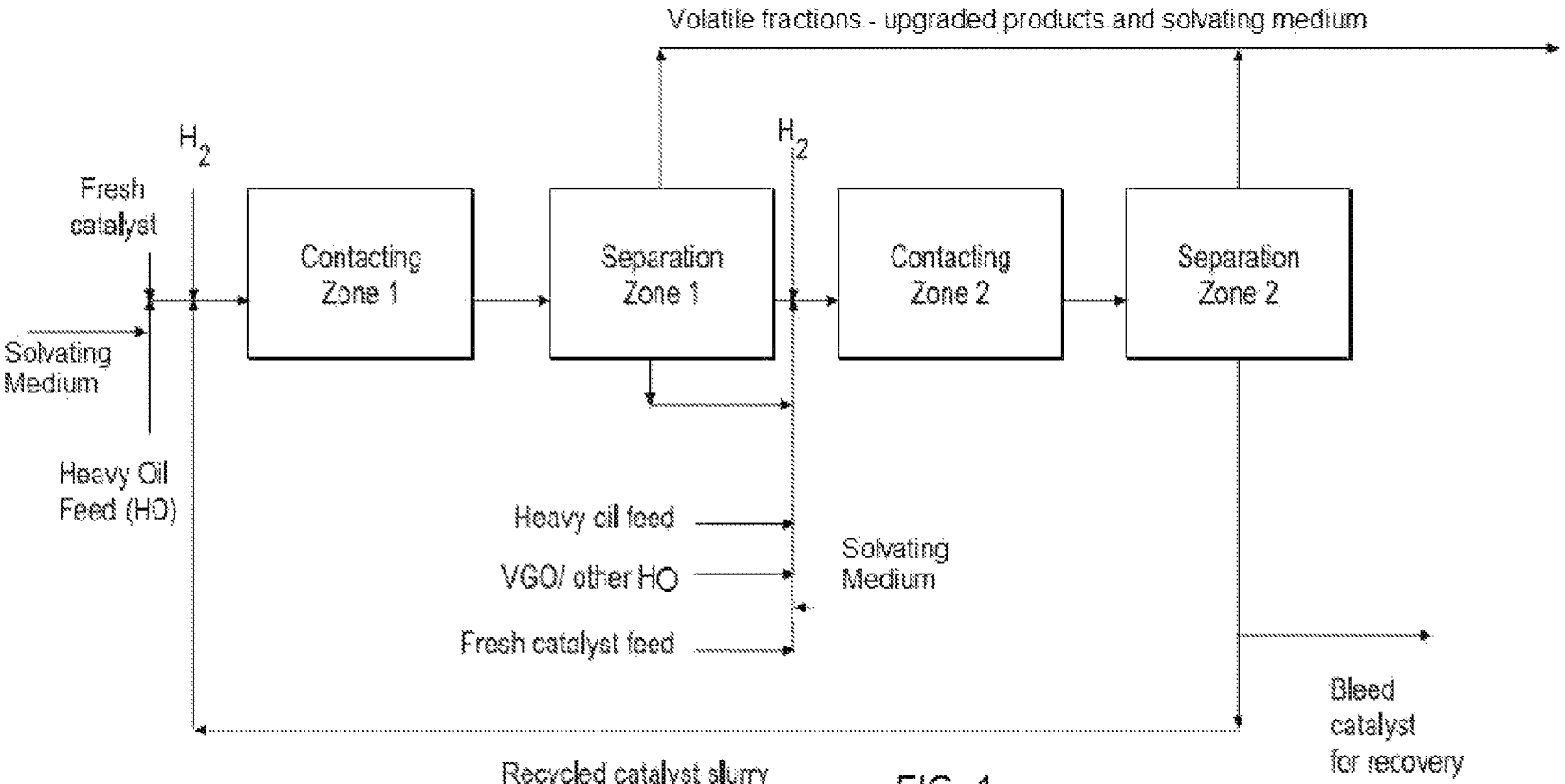
FIG. 1 is a block diagram schematically illustrating a system for upgrading heavy oil feedstock under conditions where the majority of hydrocarbons is at near critical conditions (around critical point) with a recycled stream.

The following terms will be used throughout the specification and will have the following meanings unless otherwise indicated.

As used herein, "heavy oil" feed or feedstock refers to heavy and ultra-heavy crudes, including but not limited to resids, coals, bitumen, shale oils, tar sands, etc. Heavy oil feedstock may be liquid, semi-solid, and/or solid. Examples of heavy oil feedstock that might be upgraded as described herein include but are not limited to Canadian Tar sands, vacuum resid from Brazilian Santos and Campos basins, Egyptian Gulf of Suez, Chad, Venezuelan Zulia, Malaysia, and Indonesia Sumatra. Other examples of heavy oil feedstock include bottom of the barrel and residuum left over from refinery processes, including "bottom of the barrel" and "residuum" (or "resid")—atmospheric tower bottoms, which have a boiling point of at least 343° C. (650° F.), or vacuum tower bottoms, which have a boiling point of at least 524° C. (975° F.), or "resid pitch" and "vacuum residue"—which have a boiling point of 524° C. (975° F.) or greater.

Properties of heavy oil feedstock may include, but are not limited to: TAN of at least 0.1, at least 0.3, or at least 1; viscosity of at least 10 cSt; API gravity at most 15 in one embodiment, and at most 10 in another embodiment. A gram of heavy oil feedstock typically contains at least 0.0001 grams of Ni/V/Fe; at least 0.005 grams of heteroatoms; at least 0.01 grams of residue; at least 0.04 grams C5 asphaltenes; at least 0.002 grams of MCR; per gram of crude; at least 0.00001 grams of alkali metal salts of one or more organic acids; and at least 0.005 grams of sulfur. In one embodiment, the heavy oil feedstock has a sulfur content of at least 5 wt. % and an API gravity of from −6 to +6.

In one embodiment, the heavy oil feedstock comprises Athabasca bitumen (Canada). In another embodiment, the feedstock is a Boscan (Venezuela) feed. In one embodiment, the heavy oil feedstock contains at least 100 ppm metals (as vanadium and nickel; per gram of heavy oil feedstock). In another embodiment, the V level ranges between 500 and 1000 ppm. In a third embodiment, at least 2000 ppm.

The terms "treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The terms "treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing" (or hydroconversion). Hydroprocessing is meant as any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking. The products of hydroprocessing may show improved viscosities, viscosity indices, saturates content, low temperature properties, volatilities and depolarization, etc.

As used herein, the term "slurry catalyst" (or sometimes referred to as "slurry", or "dispersed catalyst") refers to a liquid medium, e.g., oil, water, or mixtures thereof, in which catalyst and/or catalyst precursor particles (aggregates, particulates or crystallites) are dispersed within. The term slurry catalyst refers to a fresh catalyst, or a catalyst that has been used in heavy oil upgrading and with diminished activity.

In one embodiment, the slurry catalyst feed stream contains a fresh catalyst. In another embodiment, the slurry catalyst feed contains a well-dispersed catalyst precursor composition capable of forming an active catalyst in situ within the feed heaters and/or the contacting zone. The catalyst particles can be introduced into the medium (diluent) as powder in one embodiment, a precursor in another embodiment, or after a pre-treatment step in a third embodiment. In one embodiment, the medium (or diluent) is a hydrocarbon oil diluent. In another embodiment, the liquid medium is the heavy oil feedstock itself. In yet another embodiment, the liquid medium is a hydrocarbon oil other than the heavy oil feedstock, e.g., a VGO medium or diluent.

As used herein, the "catalyst feed" includes any catalyst suitable for upgrading heavy oil feed stocks, e.g., one or more bulk catalysts and/or one or more catalysts on a support. In one embodiment, the catalyst feed is in the form of a slurry catalyst.

As used herein, the term "bulk catalyst" may be used interchangeably with "unsupported catalyst," meaning that the catalyst composition is NOT of the conventional catalyst form which has, e.g., having a preformed, shaped catalyst support which is then loaded with metals via impregnation or deposition catalyst. In one embodiment, the bulk catalyst is formed through precipitation. In another embodiment, the bulk catalyst has a binder incorporated into the catalyst composition. In yet another embodiment, the bulk catalyst is formed from metal compounds and without any binder. In a fourth embodiment, the bulk catalyst is a dispersing-type catalyst for use as dispersed catalyst particles in mixture of liquid (e.g., hydrocarbon oil). In one embodiment, the catalyst comprises one or more commercially known catalysts, e.g., Microcat™ from ExxonMobil Corp.

SCF/BBL (or scf/bbl) refers to a unit of standard cubic foot of gas ($N_2$, $H_2$, etc.) per barrel of hydrocarbon feed.

$Nm^3/m^3$ refers to normal cubic meters of gas per cubic meter of heavy oil feed.

VGO or vacuum gas oil, referring to hydrocarbons with a boiling range distribution between 343° C. (650° F.) and 538° C. (1000° F.) at 0.101 MPa.

As used herein, hydrogen refers to hydrogen, and/or a compound or compounds that when in the presence of a heavy oil feed and a catalyst react to provide hydrogen.

The Periodic Table referred to herein is the Table approved by IUPAC and the U.S. National Bureau of Standards, an example is the Periodic Table of the Elements by Los Alamos National Laboratory's Chemistry Division of October 2001.

The term "Group VIII metal" refers to iron, cobalt, nickel, ruthenium, rhenium, palladium, osmium, iridium, platinum, and combinations thereof in their elemental, compound, or ionic form.

The term "Group VIB metal" refers to chromium, molybdenum, tungsten, and combinations thereof in their elemental, compound, or ionic form.

As used herein, the term "conversion rate" refers to the conversion of heavy oil feedstock to less than 1000° F. (538° C.) boiling point materials.

As used herein, the term "catalyst precursor" refers to a compound containing one or more catalytically active metals, from which compound a catalyst is eventually formed. It should be noted that a catalyst precursor may be catalytically active as a hydroprocessing catalyst. As used herein, "catalyst precursor" may be referred herein as "catalyst" when used in the context of a catalyst feed.

As used herein, the term "used catalyst" refers to a catalyst that has been used in at least a reactor in a hydroprocessing operation and whose activity has thereby been diminished. For example, if a reaction rate constant of a fresh catalyst at a specific temperature is assumed to be 100%, the reaction rate constant for a used catalyst is 95% or less in one embodiment, 80% or less in another embodiment, and 70% or less in a third embodiment. The term "used catalyst" may be used interchangeably with "recycled catalyst," "used slurry catalyst" or "recycled slurry catalyst."

As used herein, the term "fresh catalyst" refers to a catalyst or a catalyst precursor that has not been used in a reactor in a hydroprocessing operation. The term fresh catalyst herein also includes "re-generated" or "rehabilitated" catalysts, i.e., catalyst that has been used in at least a reactor in a hydroprocessing operation ("used catalyst") but its catalytic activity has been restored or at least increased to a level well above the used catalytic activity level. The term "fresh catalyst" may be used interchangeably with "fresh slurry catalyst."

As used herein, the "catalyst feed" includes any catalyst suitable for upgrading heavy oil feed stocks, e.g., one or more bulk catalysts and/or one or more catalysts on a support. The catalyst feed may include at least a fresh catalyst, recycled catalyst only, or mixtures of at least a fresh catalyst and recycled catalyst. In one embodiment, the catalyst feed is in the form of a slurry catalyst. In one embodiment, the slurry catalyst stream contains a fresh catalyst. In another embodiment, the slurry catalyst stream contains a mixture of at least a fresh catalyst and a recycled catalyst. In a third embodiment, the slurry catalyst stream comprises a recycled catalyst. In another embodiment, the slurry catalyst contains a well-dispersed catalyst precursor composition capable of forming an active catalyst in situ within the feed heaters and/or the contacting zone. The catalyst particles can be introduced into the medium (diluent) as powder in one embodiment, a precursor in another embodiment, or after a pre-treatment step in a third embodiment.

As used herein, the term "slurry catalyst" (or sometimes referred to as "slurry", or "dispersed catalyst") refers to a liquid medium, e.g., oil, water, or mixtures thereof, in which catalyst and/or catalyst precursor particles (particulates or crystallites) having very small average dimensions are dispersed within. In one embodiment, the medium (or diluent) is a hydrocarbon oil diluent. In another embodiment, the liquid medium is the heavy oil feedstock itself. In yet another embodiment, the liquid medium is a hydrocarbon oil other than the heavy oil feedstock, e.g., a VGO medium or diluent.

As used herein, the term "contacting zone" refers to an equipment in which the heavy oil feed is treated or upgraded by contact with a slurry catalyst feed and a solvating medium in the presence of hydrogen using supercritical conversion. In a contacting zone, at least a property of the crude feed may be changed or upgraded. The contacting zone can be a reactor, a portion of a reactor, multiple portions of a reactor, or combinations thereof. The term "contacting zone" may be used interchangeably with "reacting zone."

As used herein, the term "separation zone" refers to an equipment in which upgraded heavy oil feed from a contacting zone is either fed directly into, or subjected to one or more intermediate processes and then fed directly into the separation zone, e.g., a flash drum or a high pressure separator, wherein gases and volatile liquids are separated from the non-volatile fraction, which comprises unconverted heavy oil feed, a small amount of heavier hydrocracked liquid products (synthetic or non-volatile upgraded products), the slurry catalyst and any entrained solids (asphaltenes, coke, etc.).

In one embodiment, both the contacting zone and the separation zone are combined into one equipment, e.g., a reactor having an internal separator, or a multi-stage reactor-separator. In this type of reactor-separator configuration, the vapor product exits the top of the equipment, and the non-volatile fractions exit the side or bottom of the equipment with the slurry catalyst and entrained solid fraction, if any.

In one embodiment, the upgrade system comprises a single reactor followed by a separator. In another embodiment, the system comprises at least two upflow reactors in series with at least a separator, with at least a separator being positioned right after the last reactor in series. In yet another embodiment, a plurality of reactors in series operating as a single train. In a fourth embodiment, a parallel train with a plurality of reactors. In a fifth embodiment, a plurality of reactors configured in combination of parallel and series operations. There are other embodiments wherein the upgrade system is configured for flexible operation, going from one operating mode to another, e.g., running in parallel (tandem) to running in series (sequential) with different combinations of reactors/flash separators.

In one embodiment, the upgrade system may comprise a combination of reactors and separators in series with multi-stage reactor-separators, with a solvent deasphalting (SDA) unit being positioned as an interstage treatment system between any two reactors in series, or before the first reactor in the series.

Non-volatile materials from the last separation zone in the upgrade system, comprising unconverted materials, heavier hydrocracked liquid products (synthetic products or non-volatile/less-volatile upgraded products), slurry catalyst, small amounts of coke, asphaltenes, etc., in one embodiment are sent off-site for further processing/regeneration of the catalyst, or to a deoiling unit to separate the spent catalyst from the hydrocarbons, and subsequently to a metal recovery unit to recover precious metals from the spent catalyst.

The deoiling unit and/or the metal recovery unit can be in the same location as the once-through upgrade system, or they can be in a different location from the once-through upgrade system, e.g., deoiling being handled by a different party in a different location or country, and/or metal recovery is done off-site by a contractor in a different location or country.

As used herein, "dense fluid conditions" or "supercritical conditions" of a material means conditions (temperature and pressure) at which the material's phase boundary ceases to exist, wherein the material becomes a dense, highly compressible fluid that demonstrates properties of both liquid and gas. Dense fluid temperature of a material means the temperature at which a phase boundary ceases to exist for the material. Dense fluid pressure means the pressure at which a phase boundary ceases to exist for the material. The term "dense fluid" may be used interchangeably with "dense phase" or "supercritical." These dense fluid conditions are reached under conditions near the critical point of the hydrocarbon mixture. "Near" conditions mean conditions with pressure and temperature within (below or above) 10% of the pressure and temperature the critical point. Dense fluid conditions of a hydrocarbon mixture can be estimated by employing conventional equation of state calculations, e.g., using modeling tools known in the trade including HiSYS™ from ASPEN Technology Inc. or by using experimentally measured data from a PVT cell.

As used herein, the term "SC conversion" means that the heavy oil upgrade is carried out with at least a solvating medium under dense fluid conditions. In one embodiment, the SC conversion is carried out at a temperature and pressure around or above the dense fluid temperature and the dense fluid pressure of a solvating medium. In one embodiment, the SC conversion is at a temperature above the dense fluid temperature and the dense fluid pressure of the mixture of heavy oil feedstock and solvating medium. If no single, dense fluid phase is reached, the majority of the hydrocarbon mixture is in a dense fluid state.

In one embodiment, the invention provides a method to upgrade heavy oil with a hydrocarbon or mixture of hydrocarbons as the solvating medium for the high boiling heavy oil feedstock. The use of the solvating medium under dense fluid conditions allows the hydroconversion to take place at a pressure lower than required for a heavy oil upgrade process without the present of the solvating medium. Additionally, deposit build-up in equipment is expected to be significantly less with the solvating medium under dense fluid conditions.

Solvating Medium: Solvating medium (or "solvating hydrocarbon") refers to any hydrocarbon with a normal boiling point less than 538° C. (1000° F.). In one embodiment, the solvating hydrocarbon has a boiling point of less than 316° C. (600° F.). The solvating hydrocarbons can be in the form of aliphatic, cycloaliphatic, aromatic hydrocarbons, or mixtures thereof. The solvating hydrocarbon can be provided from a fresh supply external to the hydroconversion process, or it can be from a recycled source within upgrade process. A single hydrocarbon can be used as the solvating medium, or a mixture of different hydrocarbons can be employed. In one embodiment under dense fluid conditions, the solvating medium exhibit unique physical and chemical properties such as low surface tension, low viscosity, and variable solute carrying capacity.

In one embodiment, the solvating medium is a hydrocarbon having a dense fluid temperature of less than 500° C. These include paraffins or isoparaffins, e.g., those in the C8 to C20 range. In one embodiment, the solvating medium is selected from cyclic paraffins (naphthenes). In another embodiment, the solvating medium is selected from dodecane, decane, hexadecane, cyclohexane, methyl cyclohexane, tetralin, decalin, etc., and mixtures thereof.

In one another embodiment, the solvating medium is selected from the group of cyclo-aliphatic and structurally analogous aromatic solvents in the C5 to C7 range. In one embodiment, the solvating medium is a mixture of 10% aliphatic and 90% aromatic solvents. In yet another embodiment, the solvating medium is a mixture of aliphatic and aromatic solvents in the ratio of 1:20 to 2:5.

In one embodiment, the solvating hydrocarbon is naphtha, e.g., light naphtha with a boiling range of 32 to 82° C. (90 to 180° F.), or heavy naphtha with a boiling range of 82 to 221° C. (180 to 430° F.). In another embodiment, the solvating hydrocarbon is toluene. In yet another embodiment, the solvating hydrocarbon is a mixture of toluene-tetralin at a ratio ranging from 50:50 to 80:20. In a fourth embodiment, the solvating hydrocarbon is a mixture of toluene-methylcyclohexane (MCH) at a ratio ranging from 10:1 to 1:10 of toluene to MCH.

In one embodiment, solvating hydrocarbon is employed at a weight ratio of solvating medium to heavy oil feedstock of 1:1 to 20:1. In a second embodiment, the solvating medium is employed at a ratio of 3:1 to 10:1 or more (solvating medium to heavy oil feedstock). In a third embodiment, from 3:1 to 6:1. If the solvating medium to heavy oil feed ratio is too low, it can be difficult to simultaneously maintain suitable reaction pressures and temperatures, and decreased conversion and/or excessive deposit with equipment fouling or plugging can result. The exact ratio of solvating medium to heavy oil feedstock that is desired depends upon a number of factors, e.g., the dense fluid temperature of both the heavy oil and the solvating hydrocarbons. Because the heavy oil feedstock generally has high dense fluid temperatures, it is desirable to combine them with a sufficient amount of solvating medium having a lower dense fluid temperature, thus resulting in a manageable dense fluid temperature for the heavy oil feedstock-solvent mixture.

Catalyst Feed: In one embodiment for an upgrade system running in sequential mode, all of the slurry catalyst feed is provided to the first contacting zone. In other embodiments of the sequential mode, at least a portion of the catalyst feed is "split" or diverted to at least one other contacting zones in the system (other than the first contacting zone). In another embodiment with the contacting zones running in tandem (parallel), all the contacting zones in operation receive a slurry catalyst feed (along with a heavy oil feed). [046] In one embodiment, "at least a portion" means at least 10% of the catalyst feed. In another embodiment, at least 20%. In a third embodiment, at least 40%. In a fourth embodiment, at least 50% of the catalyst feed is diverted to at least a contacting zone other than the first one.

In one embodiment of a sequential operation, less than 60% of the catalyst feed is fed to the first contacting zone in the system, with 40% or more of the fresh catalyst being diverted to the other contacting zone(s) in the system. In another embodiment, the catalyst feed is being equally split between the contacting zones in the system. In one embodiment, at least a portion of the fresh catalyst feed is sent to at least one of the intermediate contacting zones and/or the last contacting zone in the system.

In yet another embodiment, the process is configured for a flexible catalyst feed scheme such that the catalyst feed can sometimes be fed at full rate (100% of the required catalyst rate) to the first reactor in the system for a certain period of time, then split equally or according to pre-determined proportions to all of the reactors in the system for a pre-determined amount of time, or split according to pre-determined proportions for the catalyst feed to be fed to the different reactors at different concentrations.

The slurry catalyst feed used herein may comprise one or more different slurry catalysts as a single catalyst feed stream or separate feed streams. In one embodiment, a single fresh catalyst feed stream is supplied to the contacting zones. In another embodiment, the fresh catalyst feed comprises multiple and different catalyst types, with a certain catalyst type going to one or more contacting zones (e.g., the first contacting zone in the system) as a separate stream, and a different slurry catalyst going to contacting zone(s) other than the 1$^{st}$ contacting zone in the system as a different catalyst stream.

In one embodiment, sending different catalysts to the front end and back end contacting zones can be useful in mitigating the vanadium trapping issue and sustain the overall upgrade performance. In one embodiment, a Ni-only or a NiMo sulfide slurry catalyst rich in Ni is sent to the front end reactor to help reduce vanadium trapping in the system, while a different catalyst, e.g., Mo sulfide or a NiMo sulfide catalyst rich in Mo, can be injected into the back end reactor(s) to maintain an overall high conversion rate, improve product quality and possibly reduce the gas yield in one embodiment. As used herein, a slurry catalyst rich in Ni means that the Ni/Mo ratio is greater than 0.15 (as wt. %) Conversely, a slurry catalyst rich in Mo means that the Ni/Mo ratio is less than 0.05 (as wt.

In one embodiment, the slurry catalyst feed is first preconditioned before entering one of the contacting zones, or before being brought into contact with the heavy oil feed before entering the contacting zones. In one example, the catalyst enters into a preconditioning unit along with hydrogen at a rate from 500 to 7500 SCF/BBL (BBL here refers to the total volume of heavy oil feed to the system). It is believed that instead of bringing a cold catalyst in contact with the heavy oil feed, the preconditioning step helps with the hydrogen adsorption into the active catalyst sites, and ultimately the conversion rate. In one embodiment in the precondition unit, the slurry catalyst/hydrogen mixture is heated to a temperature between 300° F. to 1000° F. (149 to 538° C.). In another embodiment, the catalyst is preconditioned in hydrogen at a temperature of 500 to 725° F. (260 to 385° C.). In yet another embodiment, the mixture is heated under a pressure of 300 to 3200 psi in one embodiment; 500-3000 psi in a second embodiment; and 600-2500 psi in a third embodiment.

Slurry Catalysts Employed: The slurry catalyst comprises an active catalyst in a hydrocarbon oil diluent. In one embodiment, the catalyst is a sulfided catalyst comprising at least a Group VIB metal, or at least a Group VIII metal, or at least a group IIB metal, e.g., a ferric sulfide catalyst, zinc sulfide, nickel sulfide, molybdenum sulfide, or an iron zinc sulfide catalyst. In another embodiment, the catalyst is a multi-metallic catalyst comprising at least a Group VIB metal and at least a Group VIII metal (as a promoter), wherein the metals may be in elemental form or in the form of a compound of the metal. In one example, the catalyst is a $MoS_2$ catalyst promoted with at least a group VIII metal compound.

In one embodiment, the catalyst is a bulk multi-metallic catalyst comprising at least one Group VIII non-noble metal and at least two Group VIB metals, and wherein the ratio of the at least two Group VIB metals to the Group VIII non-noble metal is from about 10:1 to about 1:10. In another embodiment, the catalyst is of the formula $(M^t)_a(X^u)_b(S^v)_d(C^w)_e(H^x)_f(O^y)_g(N^z)_h$, wherein M represents at least one group VIB metal, such as Mo, W, etc. or a combination thereof; and X functions as a promoter metal, representing at least one of: a non-noble Group VIII metal such as Ni, Co; a Group VIII metal such as Fe; a Group VIB metal such as Cr; a Group IVB metal such as Ti; a Group IIB metal such as Zn, and combinations thereof (X is hereinafter referred to as "Promoter Metal"). Also in the equation, t, u, v, w, x, y, z representing the total charge for each of the component (M, X, S, C, H, O and N, respectively); ta+ub+vd+we+xf+yg+zh=0. The subscripts ratio of b to a has a value of 0 to 5 (0<=b/a<=5). S represents sulfur with the value of the subscript d ranging from (a+0.5b) to (5a+2b). C represents carbon with subscript e having a value of 0 to 11(a+b). H is hydrogen with the value offranging from 0 to 7(a+b). O represents oxygen with the value of g ranging from 0 to 5(a+b); and N represents nitrogen with h having a value of 0 to 0.5(a+b). In one embodiment, subscript b has a value of 0, for a single metallic component catalyst, e.g., Mo only catalyst (no promoter).

In one embodiment, the catalyst is prepared from catalyst precursor compositions including organometallic complexes or compounds, e.g., oil soluble compounds or complexes of transition metals and organic acids. Examples of such compounds include naphthenates, pentanedionates, octoates, and acetates of Group VIB and Group VIII metals such as Mo, Co, W, etc. such as molybdenum naphthanate, vanadium naphthanate, vanadium octoate, molybdenum hexacarbonyl, and vanadium hexacarbonyl.

In one embodiment, the slurry catalyst has an average particle size of at least 1 micron. In another embodiment, the slurry catalyst has an average particle size in the range of 1-20 microns. In a third embodiment, the slurry catalyst has an average particle size in the range of2-10 microns. In one embodiment, the slurry catalyst particle comprises aggregates of catalyst molecules and/or extremely small particles that are colloidal in size (e.g., less than 100 nm, less than about 10 nm, less than about 5 nm, and less than about 1 nm). In yet another embodiment, the catalyst particle comprises aggregates of single layer $MoS_2$ clusters of nanometer sizes, e.g., 5-10 nm on edge. In operations, the colloidal / nanometer sized particles aggregate in a hydrocarbon diluent, forming a slurry catalyst with an average particle size in the range of 1-20 microns.

In one embodiment, a sufficient amount of slurry catalyst is fed to the contacting zone(s) for each contacting zone to have a slurry (solid) catalyst concentration of at least 500 wppm to 3 wt. % (catalyst metal to heavy oil ratio).

In one embodiment for a conversion of at least 75% from heavy oil feedstock to less than 1000° F. (538° C.) boiling point materials at a high through put of at least 0.15 LHSV, the amount of catalyst feed into the contacting zone(s) ranges from 500 to 7500 wppm of the catalyst metal in heavy oil feed. In a second embodiment, the concentration of the fresh catalyst feed ranges from 750 to 5000 wppm catalyst metal. In a third embodiment, from 1000 to 3000 wppm. In a fourth embodiment, the concentration is less than 3000 wppm. In a fifth embodiment, the concentration is at least 1200 ppm. Catalyst metal refers to the active metal in the catalyst, e.g., for a NiMo sulfide slurry catalyst in which Ni is used as a promoter, the catalyst metal herein refers to the Mo concentration.

It is conceivable to use less catalyst for the upgrade system, e.g., less than 500 ppm or even less than 200 ppm or 100 ppm. However, this will result in very poor/undesirable conversion rate of less than 50% in one embodiment, and even less than 10% in a second embodiment. The low catalyst level further results in unstable operations, e.g., letdown, coking, plugging, etc. with unconverted heavy oil in the equipment, particularly the reactors.

Hydrogen Feed: Molecular hydrogen can be added to the upgrade process directly into the contacting zone(s) as a separate feed source, or it can be added to the feedstock mixture. The addition of hydrogen can in some cases increase the conversion of heavy oil, and remove sulfur and nitrogen through the formation of $H_2S$ and ammonia, while at the same time leading to decreased production of coke.

In one embodiment, the hydrogen source is provided to the upgrade process at a rate (based on ratio of the gaseous hydrogen source to the heavy oil feedstock) of 0.1 $Nm^3/m^3$ to about 100,000 $Nm^3/m^3$ (0.563 to 563,380 SCF/bbl), about 0.5 $Nm^3/m^3$ to about 10,000 $Nm^3/m^3$ (2.82 to 56,338 SCF/bbl), about 1 $Nm^3/m^3$ to about 8,000 $Nm^3/m^3$(5.63 to 45,070 SCF/bbl), about 2 $Nm^3/m^3$ to about 5,000 $Nm^3/m^3$ (11.27 to 28,169 SCF/bbl), about 5 $Nm^3/m^3$ to about 3,000 $Nm^3/m^3$ (28.2 to 16,901 SCF/bbl), or about 10 $Nm^3/m^3$ to about 800 $Nm^3/m^3$ (56.3 to 4,507 SCF/bbl).

In one embodiment of a process with a plurality of contacting zones in series, some of the hydrogen (25-75%) is supplied to the first contacting zone, and the rest is added as supplemental hydrogen to other contacting zones in system.

The hydrogen source, in some embodiments, is combined with carrier gas(es) and recirculated through the contacting zone. Carrier gas may be, for example, nitrogen, helium, and/or argon. The carrier gas may facilitate flow of the crude feed and/or flow of the hydrogen source in the contacting zone(s). The carrier gas may also enhance mixing in the contacting zone(s). In some embodiments, a hydrogen source (for example, hydrogen, methane or ethane) may be used as a carrier gas and recirculated through the contacting zone.

In one embodiment, the hydrogen feed enters the contacting zone co-currently with the heavy oil feed in the same conduit. In another embodiment, the hydrogen source may be added to the contacting zone in a direction that is counter to the flow of the crude feed. In a third embodiment, the hydrogen enters the contacting zone via a gas conduit separately from the combined heavy oil, solvating medium, and slurry catalyst feed stream(s). In a fourth embodiment, the hydrogen feed is introduced directly to the combined catalyst and heavy oil feedstock/solvating medium prior to being introduced into the contacting zone. In yet another embodiment, the hydrogen gas, the combined heavy oil/solvating medium, and the catalyst feed are introduced at the bottom of the reactor as separate streams. In yet another embodiment, hydrogen gas can be fed to several sections of the contacting zone. In another embodiment, some of the hydrogen gas is fed to a preconditioning unit to precondition the slurry catalyst.

Heavy Oil Feed: The heavy oil feed here herein may comprise one or more different heavy oil feeds from different sources as a single feed stream, or as separate heavy oil feed streams. In one embodiment, a single heavy oil conduit pipe goes to all the contacting zones. In another embodiment, multiple heavy oil conduits are employed to supply the heavy oil feed to the different contacting zones, with some heavy oil feed stream(s) going to one or more contacting zones, and other heavy oil feed stream(s) going to one or more different contacting zones.

In some embodiments, at least a portion of the heavy oil feed (to be upgraded) is "split" or diverted to at least one other contacting zones (other than the first contacting zone), or to a SDA unit prior to being fed into a contacting zone. In one embodiment of a sequential operation, less than 90% of the unconverted heavy oil feed is fed to the first reactor in the system, with 10% or more of the unconverted heavy oil feed being diverted to the other contacting zone(s) in the system. In another embodiment of a tandem operation, the heavy oil feed is being equally split between the contacting zones in the system. In yet another embodiment, less than 80% of the unconverted heavy oil feed is fed to the first contacting zone in the system, and the remaining heavy oil feed is diverted to the last contacting zone in the system. In a fourth embodiment, less than 60% of the heavy oil feed is fed to the first contacting zone in the system, and the remainder of the unconverted heavy oil feed is equally split between the other contacting zones in the system.

In one embodiment, the heavy oil feedstock is preheated prior to being blended with the slurry catalyst feed stream(s). In another embodiment, the blend of heavy oil feedstock and slurry catalyst feed is preheated to create a feedstock that is sufficiently of low viscosity to allow good mixing of the catalyst into the feedstock. In one embodiment, the preheating is conducted at a temperature that is at least about 100° C. (212° F.) less than the hydrocracking temperature within the contacting zone. In another embodiment, the preheating is at a temperature that is about at least 50° C. less than the hydrocracking temperature within the contacting zone. In a third embodiment, the preheating of the heavy oil feedstock and/or a mixture of heavy oil feedstock and slurry catalyst is at a temperature of 500-700° F. (260-371° C.).

Optional Additional Hydrocarbon Feed: In one embodiment, additional hydrocarbon oil feed, e.g., VGO (vacuum gas oil), naphtha, MCO (medium cycle oil), light cycle oil (LCO), heavy cycle oil (HCO), solvent donor, or other aromatic solvents, etc. in an amount ranging from 2 to 40 wt. % of the heavy oil feed, can be optionally added as part of the heavy oil feed stream to any of the contacting zones in the system. In one embodiment, the additional hydrocarbon feed functions as a diluent to lower the viscosity of the heavy oil feed.

Pre-heating of Heavy Oil Feedstock and Solvating Hydrocarbon: The heavy oil feedstock (with or without slurry catalyst feed, or with or without additional hydrocarbon feed) and the solvating medium can be fed to the contacting zone(s) as two separate streams, or as a single feed stream after premixing. In one embodiment wherein the heavy oil feedstock is first pre-mixed with the solvating medium, the solvating medium-feedstock mixture is heated in a pre-heater to a temperature as high as possible without forming coke in the preheating unit. In one embodiment, the mixture is preheated to a temperature ranging from 100 to 400° F. below $T_c$ of the mixture. In a second embodiment, the preheat temperature is set to be from 100 to 200° F. below Tc of the mixture.

Process Conditions: The heavy oil upgrade is carried out under conditions where the majority of hydrocarbons is at near critical conditions (e.g., within 10% of the pressure and temperature of the critical point or SC conditions). In one embodiment, the heavy oil upgrade is carried out at a temperature and pressure high enough that they are within the SC conditions of at least one of the reactants, e.g., one of the solvating hydrocarbons such as toluene. In another embodiment, the heavy oil upgrade is carried out under optimal conditions, i.e., Pc and Tc of the mixture of heavy oil feed and the solvating medium. Of course, pressures and temperatures outside the above-specified ranges can be used based on the heavy oil being upgraded, the solvating medium employed, and other process conditions.

In one embodiment, the heavy oil upgrade is carried out at a pressure of at least 50 psia above the dense fluid pressure of the heavy oil, slurry catalyst, and solvating medium mixture, i.e., the "reaction mixture." In another embodiment, the upgrade is carried out at a pressure and a temperature within 8% of the SC conditions. In a third embodiment, at a pressure and temperature within 5% of the SC conditions. In a fourth embodiment, the upgrade is carried out at a pressure in the range of 100 to 200 psia above the dense fluid pressure of the reaction mixture. In a fifth embodiment, the upgrade is at a pressure ranging from 25 to 200 psia above the dense fluid pressure of the reaction mixture. In a fourth embodiment, the upgrade is at a pressure within 200 psia of the dense fluid pressure of the mixture (above or below).

In one embodiment, the reaction zone process pressure (the dense fluid pressure) is at least 500 psi less than the process pressure of a comparable hydroconversion process in the prior art for the same conversion rate. In a second embodiment, the process pressure is at least 800 psi less than a prior art process pressure. In a third embodiment, at least 1000 psi less than the pressure of a comparable hydroconversion process. In one embodiment, the reaction zone process pressure is maintained between 4.8 to 13.8 MPa (715 to 2015 psia). In a second embodiment, between 5.5 to 12.4 MPa (815 to 1815 psia). In a third embodiment, between 8.3 to 11.0 MPa (1215 to 1615 psia). In a fourth embodiment, at a pressure between 2.8 to 5.5 MPa (400 to 800 psia). In a fifth embodiment, at a pressure between 4.8 to 6.9 MPa (700 to 1000 psia).

In one embodiment, the reaction temperature is maintained between 371 to 593° C. (700 to 1100° F.). In a second embodiment, between 440 to 524° C. (825 to 975° F.). In one embodiment, the reaction is carried out at a pressure and temperature above the dense fluid pressure and temperature of the mixture of feedstock/solvating hydrocarbons, rather than just the dense fluid temperature and pressure of the solvating hydrocarbons.

In one embodiment with the use of a separation zone to recover the solvating medium and upgraded products, the temperature of the separation zone is maintained within ±90° F. (about +50° C.) of the contacting zone temperature. In another embodiment, within +70° F. (about +38.9° C.). In a third embodiment, within +15° F. (about +8.3° C.). In a fourth embodiment, within +5° F. (about +2.8° C.). In one embodiment with the use of multiple separation zones, the temperature difference between the last separation zone and the immediately preceding contacting zone is within +50° F. (about +28° C.).

In one embodiment, the liquid hourly space velocity (LHSV) of the heavy oil feed will generally range from about 0.025 $h^{-1}$ to about 10 $h^{-1}$, about 0.5 $h^{-1}$ to about 7.5 $h^{-1}$, about 0.1 $h.^{-1}$ to about 5 $h^{-1}$, about 0.75 $h^{-1}$ to about 1.5 $h^{-1}$, or about 0.2 $h^{-1}$ to about 10 $h^{-1}$. In some embodiments, LHSV is at least 0.5 $h^{-1}$, at least 1 $h^{-1}$, at least 1.5 $h^{-1}$, or at least 2 $h^{-1}$. In some embodiments, the LHSV ranges from 0.025 to 0.9 $h^{-1}$. In another embodiment, the LHSV ranges from 0.1 to 3 LHSV. In another embodiment, the LHSV is less than 0.5 $h^{-1}$.

Process Configuration: The heavy oil upgrade under SC condition can be carried out in either a batch mode, a continuous mode, semi-continuous, or automatic mode. Additionally, the heavy oil upgrade can be carried out in a single contacting zone, a plurality of contacting zones in series with at least a separating zone in between some of the contacting zones, a plurality of contacting zones in parallel, a plurality of contacting zone in series without any separating zone in between.

The heavy oil upgrade can be carried out in either once-through mode or recycle mode. In one embodiment, the upgrade system is operated in once-through mode, meaning that that slurry catalyst and heavy oil feedstock flow through the contacting zone(s) once, instead of being recycled or recirculated around the system. In the once-through upgrade system, virtually none of the non-volatile materials is recycled back to the $1^{st}$ (or previous) contacting zone or reactor in the series.

In another embodiment, the upgrade system operates in a recycle mode. In one embodiment of a recycle mode operation, at least a portion of a non-volatile stream from at least one of the separation zones and/or an interstage deasphalting unit is recycled back to the front end contacting zone(s) ("recycled stream"). In one embodiment, this recycled stream ranges between 3 to 50 wt. % of total heavy oil feedstock to the process. The non-volatile stream typically unconverted materials, heavier hydrocracked liquid products, slurry catalyst, small amounts of coke, asphaltenes, etc. In one embodiment, the recycled stream contains between 3 to 30 wt. % slurry catalyst. In another embodiment, the catalyst amount ranges from 5 to 20 wt. % . In yet another embodiment, the recycled stream contains 1 to 15 wt. % slurry catalyst.

With respect to the mixing of various components in the upgrade process, e.g., the mixing of the heavy oil feed with the slurry catalyst, the mixing of the heavy oil feed and the solvating medium, etc., can be done using means known in the art including static mixers, spray nozzles, sonic and/or ultrasonic agitation, in-line mixers, etc.

In one embodiment of an upgrade process having a plurality of contacting zones, the process condition is controlled to be more or less uniformly across the contacting zones. In another embodiment, the condition varies between the contacting zones, depending on whether it is the first or the last contacting zone in the series.

In one embodiment, the upgrade process comprises a plurality of reactors for contacting zones, with the reactors being the same or different in configurations. Examples of reactors that can be used herein include plug flow reactors, stacked bed reactors, fixed bed reactors, ebullating bed reactors, continuous stirred tank reactors, fluidized bed reactors, spray reactors, liquid/liquid contactors, slurry reactors, liquid recirculation reactors, and combinations thereof. In one embodiment, the reactor is an up-flow reactor. In another embodiment, a down-flow reactor. In one embodiment, the contacting zone refers to at least a slurry-bed hydrocracking reactor in series with at least a fixed bed hydrotreating reactor. In another embodiment, at least one of the contacting zones further comprises an in-line hydrotreater, capable of removing over 70% of the sulfur, over 90% of nitrogen, and over 90% of the heteroatoms in the crude product being processed.

In one embodiment, both the contacting zone and the separation zone are combined into one equipment, e.g., a reactor having an internal separator, or a multi-stage reactor-separator. In this type of reactor-separator configuration, the vapor product exits the top of the equipment, and the non-volatile fraction exits the side or bottom of the equipment with the slurry catalyst and entrained solid fraction, if any.

In one embodiment, the upgrade system comprises two upflow reactors in series with two separators, with each separator being positioned right after each reactor. In another embodiment, the upgrade system comprises three upflow reactors and three separators in series, with each of the separators being positioned right after each reactor. In yet another embodiment, the upgrade system comprises a plurality of multi-stage reactor-separators in series. In a fourth embodiment, the upgrade system may comprise a combination of separate reactors in series with multi-stage reactor-separators.

In one embodiment for a once-through upgrade process, the upgrade system comprises two reactors in series without intermediate product removal/separator. In another embodiment of a once-through upgrade process, the system comprises a plurality of reactors in parallel, with the heavy oil feedstock being split/fed to the separate reactors in parallel and processed under SC conditions. In yet another embodiment of a once-through upgrade process, the system comprises a plurality of reactors in parallel, with at least a conventional disengager and/or cyclonic separator to separate solids/slurry from the effluent stream of the reactors.

In one embodiment of an upgrade process, the system may comprise seperators in series with the reactors to recover and separate the solvating medium from upgraded products and unconverted heavy oil feed, with the recovered solvating medium to be consequently recycled to the reactors in the feed mixture. In one embodiment, distillation processes can be employed to isolate specific hydrocarbons for use as recycled solvating medium.

In one embodiment of a once-through upgrade run with a single contacting zone, the contacting zone has a residence time ranging from ½ to 5 hours. In a second embodiment, the contacting zone has a residence (soak) time ranging from 1 to 3 hours. In a third embodiment, the residence time ranges from 2-3 hours. In one embodiment of a once-through upgrade process, the contacting zone comprises a plurality of reactors in series, providing a total residence time ranging from 0.1 to 15 hours. In a second embodiment, the resident time ranges from 0.5 to 5 hrs. In a third embodiment, the total residence time in the contacting zone ranges from 0.2 to 2 hours.

In one embodiment of a once-through upgrade configuration, the mixture of the slurry catalyst, hydrogen gas, heavy oil feedstock, and solvating medium circulate in a reactor, wherein under SC conditions and with at least a solvating hydrocarbon, the heavy oil feedstock is converted to hydrocarbon gas vapor, light and middle hydrocarbon distillate, light and heavy vacuum gas oil (VGO) (collectively "upgraded products"). The effluent containing the upgraded products, recycled hydrogen, unconverted heavy oil, catalyst slurry, and solvent is sent to a second reactor in series, or in one embodiment, directly to a separation zone, e.g., a high pressure high temperature flash separator operating at a temperature within +90° F. (about +50° C.) of the contacting zone temperature.

Optional Preheating of Heavy Oil Feedstock/Solvating Medium: In one embodiment, the heavy oil feedstock is preheated prior to being blended with the slurry catalyst feed and/or the solvating medium. The preheating creates a feedstock that is sufficiently of low viscosity to allow good mixing of the heavy oil feedstock with the catalyst and/or the solvating medium. In another embodiment, a mixture of heavy oil feedstock and solvating medium is preheated in a mixing tank prior to being introduced to the contacting zone(s).

In one embodiment, the preheating is conducted at a temperature that is about 100° C. (180° F.) less than the hydrocracking temperature within the contacting zone. In another embodiment, the preheating is at a temperature that is about 50° C. less than the hydrocracking temperature within the contacting zone.

Optional Heavy Oil Split Feed Scheme: In one embodiment, at least a portion of the heavy oil feed (to be upgraded) is "split" or diverted to at least one other contacting zones in the system (other than the first contacting zone).

In one embodiment, "at least a portion" meaning at least 5% of the heavy oil feed to be upgraded. In another embodiment, at least 10%. In a third embodiment, at least 20%. In a fourth embodiment, at least 30% of the heavy oil feed is diverted to at least a contacting zone other than the first one in the system.

In one embodiment, less than 90% of the unconverted heavy oil feed is fed to the first reactor in the system along with the solvating medium, with 10% or more of the unconverted heavy oil feed being diverted to the other contacting zone(s) in the system. The diverted heavy oil feedstock is provided with or without any solvating medium, and at the same or different solvating medium to heavy oil feedstock ratio compared with the first reactor. In another embodiment, the heavy oil feed is being equally split between the contacting zones in the system. In yet another embodiment, less than 80% of the unconverted heavy oil feed is fed to the first contacting zone in the system, and the remaining heavy oil feed is diverted to the last contacting zone in the system. In a fourth embodiment, less than 60% of the heavy oil feed is fed to the first contacting zone in the system, and the remainder of the unconverted heavy oil feed is equally split between the other contacting zones in the system.

The unconverted heavy oil feed herein may comprise one or more different heavy oil feeds from different sources as a single feed stream or separate heavy oil feed streams. In one embodiment, a single heavy oil conduit pipe goes to all the contacting zones. In another embodiment, multiple heavy oil conduits are employed to supply the heavy oil feed to the different contacting zones, with some heavy oil feed stream(s) going to one or more contacting zones, and some of the other unconverted heavy oil feed stream(s) going to one or more different contacting zones.

Optional Catalyst Preconditioning: In one embodiment, the slurry catalyst is first preconditioned before entering one of the contacting zones, or before being brought into in contact with the heavy oil feed before entering the contacting zones.

In one example, the catalyst is preconditioned by hydrogen, e.g., a fresh catalyst slurry is fed to a preconditioning unit along with hydrogen at a rate from 500 to 7500 SCF/BBL (BBL here refers to the total volume of heavy oil feed to the system). In another embodiment, the catalyst/hydrogen mixture is heated to a temperature between 400° F. to 1000° F., and under a pressure of 300 to 2500 psi in one embodiment; 500-3000 psi in a second embodiment; and 600-3200 psi in a third embodiment. In another example, the catalyst is preconditioned in hydrogen at a temperature of 500 to 725 ° F. It is believed that instead of bringing a cold catalyst in contact with the heavy oil feed, the preconditioning step helps with the hydrogen adsorption into the active catalyst sites, and ultimately the conversion rate.

In another embodiment, a catalyst slurry (comprising fresh catalyst, or recycled catalyst, or a mixture of fresh and recycled catalyst) is preconditioned by the use of at least a solvating medium. In one embodiment, a mixture of catalyst slurry and solvating medium in a ratio of 1:1 to 6:1 (solvent to catalyst slurry) is fed to a preconditioning unit, wherein the catalyst is preconditioned under SC conditions prior to being brought into contact with the heavy oil feedstock and/or more solvating medium in the contacting zone.

Optional Catalyst Split-Feed Scheme: In some embodiments of the present invention, at least a portion of the fresh catalyst is "split" or diverted to at least one other contacting zones in the system (other than the first contacting zone).

It should be further noted that the catalyst feed to the different contacting zones can be different, e.g., different catalysts can be fed into the first and last reactor in series to mitigate deposit build-up with a high-performance catalyst to the back-end reactor to maintain the overall high performance/conversion rate and less deposit build-up.

In one embodiment, "at least a portion" means at least 10% of the fresh catalyst. In another embodiment, at least 20%. In a third embodiment, at least 40%. In a fourth embodiment, at least 50% of the fresh catalyst is diverted to at least a contacting zone other than the first one in the system. In a fifth embodiment, all of the fresh catalyst is diverted to a contacting zone other than the $1^{st}$ contacting zone.

In one embodiment, less than 20% of the fresh catalyst is fed to the first reactor in the system, with 80% or more of the fresh catalyst being diverted to the other contacting zone(s) in the system. In another embodiment, the fresh catalyst is being equally split between the contacting zones in the system. In one embodiment, at least a portion of the fresh catalyst feed is sent to at least one of the intermediate contacting zones and/or the last contacting zone in the system. In another embodiment, all of the fresh catalyst is sent to the last contacting zone in the system, with the first contacting zone in the system only getting recycled catalyst from one or more of the processes in the system, e.g., from one of the separation zones in the system or from a solvent deasphalting unit.

In yet another embodiment, the upgrade process is configured for a flexible catalyst feed scheme such that the fresh catalyst can sometimes be fed entirely to the last reactor in the system for certain process conditions (for certain desired product characteristics), or 50% to the first reactor in the system for some of the process runs, or split equally or according to pre-determined proportions to all of the reactors in the system, or split according to pre-determined proportions for the same fresh catalyst to be fed to the different reactors at different concentrations.

The fresh catalyst feed used may comprise one or more different fresh catalysts as a single catalyst feed stream or separate feed streams. In one embodiment, a single fresh catalyst feed stream is supplied to the contacting zones. In another embodiment, the fresh catalyst feed comprises multiple and different fresh catalysts to the contacting zones, with some of fresh catalyst stream(s) going to one or more contacting zones, and some of the other fresh catalyst stream(s) going to one or more different contacting zones.

In one embodiment, the fresh catalyst is combined with the recycled catalyst stream from one of the processes in the system, e.g., a separation zone, a distillation column, a SDA unit, or a flash tank, and the combined catalyst feed is thereafter blended with heavy oil feedstock for feeding into the contacting zone(s). In another embodiment, the fresh catalyst and the recycled catalyst streams are blended into the heavy oil feedstock as separate streams.

Optional Additives to the Heavy Oil Feed/Catalyst Feed: In one embodiment, at least an additive is added to the heavy oil feed and/or the catalyst feedstock. The additive selected from anti-foam agents, inhibitors, stabilizers, metal scavengers, metal contaminant removers, metal passivators, and sacrificial materials is added to the contacting zone in an amount ranging from 1 to 20,000 ppm of the heavy oil feed (collectively, "additive material"). In a second embodiment, the additive material is added in an amount of less than 10,000 ppm. In a third embodiment, the additive material ranges from 50 to 1000 ppm.

It should be noted that some additives may have multiple functions. In one embodiment, some metal scavengers may also function as metal contaminant removers and/or metal passivators under the appropriate conditions. In another embodiment, the sacrificial material used may function as a metal scavenger for adsorbing heavy metals in the heavy oil feed. Some other sacrificial materials, besides functioning as a metal scavenger for absorbing metals, also absorb or trap other materials including deposited coke.

In one embodiment, the additive material is added directly to the heavy oil feedstock. In another embodiment, the additive material is added to the slurry catalyst feed. In a third embodiment, the additive material is added to the contacting zone as a separate feed stream.

In one embodiment, the additive material can be added as is, or in a suitable diluent or carrier solvent. In one embodiment, the additive material is a "sacrificial material" (or "trapping material") which functions to trap, or for the deposit of, and/or immobilization of deposited coke and/or metals (Ni, V, Fe, Na) in the heavy oil feed, mitigating the detrimental effects on these materials on the catalyst and/or equipment. In another embodiment, the additive material functions to immobilize/adsorb the asphaltenes in the heavy oil feedstock, thus mitigating catalyst deactivation. In one embodiment, the sacrificial material has large pores, e.g, having a BET surface area of at least 1 $m^2/g$ in one embodiment, at least 10 $m^2/g$ in a second embodiment, and at least 25 $m^2/g$ in another embodiment. In yet another embodiment, the additive material is a sacrificial material having a pore volume of at least 0.005 $cm^3/g$. In one embodiment, the sacrificial material comprises a large pore inert material such microspheres of calcined kaolin clay. In another embodiment, the scavenger/trapping/scavenger material originates from a slurry catalyst, specifically, a spent slurry catalyst in a dry powder form. In yet another embodiment, the additive is a scavenger/trapping/scavenger material originated from a spent deoiled slurry catalyst, wherein some or most of the metals have been removed. In a fourth embodiment, the sacrificial material is carbon black which is selected due to its high surface area, various pore size structure, and easy recovery/separation from heavy metals by combustion. In a fifth embodiment, the additive material comprises activated carbon having large surface area, e.g., a pore area of at least 100 $m^2/g$, and a pore diameter range between 100 to 400 Angstrom. In another embodiment, the additive material comprises carbon black having an average particle size ranging from 1 to 100 microns and a BET surface area of at least 10 $m^2/g$.

Examples of additive materials for use in trapping deposits/metal scavenging include but are not limited to silicate compounds such as $Mg_2SiO_4$ and $Fe_2SiO_4$; inorganic oxides such as iron oxide compounds, e.g., $FeO.Fe_2O_3$, FeO, $Fe_3O_4$, $Fe_2O_3$, etc. Other examples of additive materials include silicate compounds such as fume silica, $Al_2O_3$, MgO, $MgAl_2O_4$, zeolites, microspheres of calcined kaolin clay, titania, active carbon, carbon black, and combinations thereof. Examples of metal passivators include but are not limited to alkaline earth metal compounds, antimony, and bismuth.

Optional Treatment System—SDA: In one embodiment of the invention, a solvent deasphalting unit (SDA) is employed before the first contacting zone to pre-treat the heavy oil feedstock. In yet another embodiment, a solvent deasphalting unit is employed as an intermediate unit located after one of the intermediate separation zones.

SDA units are typically used in refineries to extract incremental lighter hydrocarbons from a heavy hydrocarbon stream, whereby the extracted oil is typically called deasphalted oil (DAO), while leaving a residue stream behind that is more concentrated in heavy molecules and heteroatoms, typically known as SDA Tar, SDA Bottoms, etc. The SDA can be a separate unit or a unit integrated into the upgrade system.

Various solvents may be used in the SDA, ranging from propanes to hexanes, depending on the desired level of deasphalting prior to feeding the contact zone. In one embodiment, the SDA is configured to produce a deasphalted oil (DAO) for blending with the catalyst feed or feeding directly into the contacting zones instead of, or in addition to the heavy oil feed. As such, the solvent type and operating conditions can be optimized such that a high volume and acceptable quality DAO is produced and fed to the contacting zone. In this embodiment, a suitable solvent to be used includes, but is not limited to hexane or similar C6+ solvent for a low volume SDA Tar and high volume DAO. This scheme would allow for the vast majority of the heavy oil feed to be upgraded in the subsequent contacting zone, while the very heaviest bottom of the barrel bottoms that does not yield favorable incremental conversion economics due to the massive hydrogen addition requirement, to be used in some other manner.

In one embodiment, all of the heavy oil feed is pre-treated in the SDA and the DAO product is fed into the first contacting zone, or fed according to a split feed scheme with at least a portion going to a contacting zone other than the first in the series. In another embodiment, some of the heavy oil feed (depending on the source) is first pre-treated in the SDA and some of the feedstock is fed directly into the contacting zone(s) untreated. In yet another embodiment, the DAO is combined with the untreated heavy oil feedstock as one feed stream to the contacting zone(s). In another embodiment, the DAO and the untreated heavy oil feedstock are fed to the system in separate feed conduits, with the DAO going to one or more of the contacting zones and the untreated heavy oil feed going to one or more of the same or different contacting zones.

In an embodiment wherein the SDA is employed as an intermediate unit, the non-volatile fraction containing the slurry catalyst and optionally minimum quantities of coke/asphaltenes, etc. from at least one of the separation zones is sent to the SDA for treatment. From the SDA unit, the DAO is sent to at least one of the contacting zones as a feed stream by itself, in combination with a heavy oil feedstock as a feed, or in combination with the bottom stream from one of the separation zones as a feed. The DA Bottoms containing asphaltenes are sent away to recover metal in any carry-over slurry catalyst, or for applications requiring asphaltenes, e.g., blended to fuel oil, used in asphalt, or utilized in some other applications.

In one embodiment, the quality of the DAO and SDA Bottoms is varied by adjusting the solvent used and the desired recovery of DAO relative to the heavy oil feed. In an optional pretreatment unit such as the SDA, the more DAO oil that is recovered, the poorer the overall quality of the DAO, and the poorer the overall quality of the SDA Bottoms. With respect to the solvent selection, typically, as a lighter solvent is used for the SDA, less DAO will be produced, but the quality will be better, whereas if a heavier solvent is used, more DAO will be produced, but the quality will be lower. This is due to, among other factors, the solubility of the asphaltenes and other heavy molecules in the solvent.

Process Yield: In one embodiment, the upgrade system using bulk catalyst and under SC conditions produces a volume yield of at least 110% (compared to the heavy oil input) in upgraded products, as added hydrogen expands the heavy oil total volume. The upgraded products, i.e., lower boiling hydrocarbons, in one embodiment include liquefied petroleum gas (LPG), gasoline, jet, diesel, vacuum gas oil (VGO), and fuel oils. In a second embodiment, the upgrade system provides a volume yield of at least 115% in the form of LPG, naphtha, jet diesel, VGO and fuel oils.

In one embodiment of the upgrade system employing a recycled scheme, at least 95 wt % of heavy oil feed is converted to lighter products. In a second embodiment, at least 90% of heavy oil feed is converted to lighter products. In a third embodiment, the conversion rate is at least 85%. In a fourth embodiment, the conversion rate is at least 80%. In a fifth embodiment, the conversion rate is at least 75%.

In one embodiment of the upgrade system in once-through mode with at least two reactors, at least 75 wt. % of the heavy oil feed is converted to lighter products. In a second embodiment, the upgrade system gives at least 80% conversion rate. In a third embodiment, the conversion rate is at least 85%. In a fourth embodiment, at least 90%. In a fourth embodiment, at least 85%.

In one embodiment of the upgrade system, it is noted that heterogeneous catalytic reactions in a reaction media with at least a solvating hydrocarbon provide improved performance compared to similar catalyst reactions in the prior art not operating under SC conditions, perhaps due to better mass transport and less deactivation of the catalyst system. It is also noted that solids (deposit) build-up on bulk catalyst to be significantly lower for the reaction media with at least a solvating medium and under SC conditions. In one embodiment, the build-up is at least 10% less than a comparable run (same feedstock type and same catalyst concentration) in the heavy oil upgrade process in the prior art without the solvating medium and not under SC conditions. In another embodiment, the build-up is at least 20% less. In a third embodiment, at least 30% less build-up. The lower deposit build-up indicates that the catalyst is expected to have slower deactivation rate, allowing the catalyst to have a longer service life particularly in high conversion upgrade processes with the recycle of slurry catalyst.

In another embodiment with a SC upgrade system, it is noted that at the higher temperatures (and lower pressure under SC conditions), conversions are significantly higher than a comparable upgrade system in the prior art not under SC conditions and without the solvating medium. This may be due to a lower deactivation of the catalytic material when a solvating medium is present. In a prior art upgrade system running under recycled mode, the catalyst slurry in the recycled stream typically retains less than 5% of its original catalytic activity, and in one embodiment, from 1-3% of its catalytic activity. In one embodiment of a heavy oil upgrade under SC conditions, the catalyst slurry in the recycled stream retains at least 7% of its catalytic activity. In a second embodiment, at least 10% of its original catalytic activity.

Reference will be made to the figures to further illustrate embodiments of the invention.

FIG. 1 is a block diagram schematically illustrating a system for upgrading heavy oil feedstock under SC conditions with a recycled stream. First, a heavy oil feedstock is introduced into the first contacting zone together with a slurry catalyst feed and a solvating medium. In the figure, the slurry catalyst feed comprises a combination of fresh catalyst and recycled catalyst slurry as separate streams. Hydrogen may be introduced together with the feed in the same conduit, or optionally, as a separate feed stream. Water and/or steam (not shown) may be optionally fed to the system with the heavy oil feed, solvating medium, and slurry catalyst in the same conduit or a separate feed stream.

As illustrated, upgraded material is withdrawn from the first contacting zone and sent to a separation zone, e.g., a hot separator, wherein gas and volatile liquids including the solvating medium are separated from the non-volatile fractions comprising unconverted heavy oil and spent slurry catalyst. The non-volatile fractions are sent to the next contacting zone in the series with optional additional fresh catalyst, optional additional heavy oil feed, optional recycled catalyst (not shown), and optional additional solvating medium. Gas and volatile liquids are sent to downstream separators/distillation columns for recovery, including recovery/recycling of solvating hydrocarbons.

Although not shown, the mixture of solvating medium, heavy oil feed, and slurry catalyst can be preheated in a heater prior to feeding into the contacting zone(s). Furthermore, additional hydrocarbon oil feed, e.g., VGO, naphtha, medium cycle oil (MCO), light cycle oil (LCO), heavy cycle oil (HCO), etc., in an amount ranging from 2 to 30 wt. % of the heavy oil feed can be optionally added as part of the feed stream to any of the contacting zones in the system.

Figure 2:
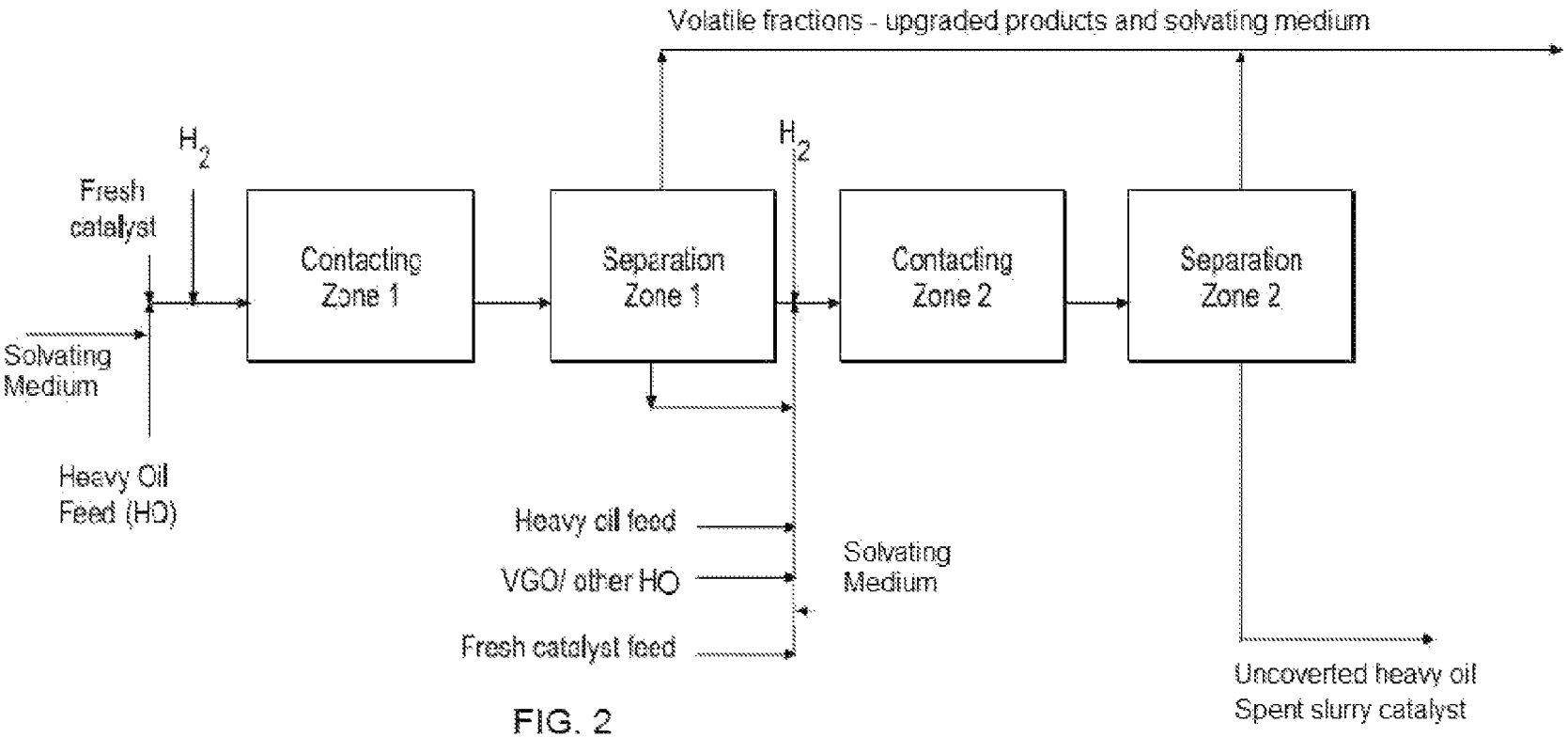

FIG. 2 is a block diagram schematically illustrating a system for upgrading heavy oil feedstock under once-through SC conditions, with two contacting zones in series and each with a separator in between.

In the contacting zone and under hydrocracking conditions, the heavy oil feedstock is upgraded to lower boiling hydrocarbons. Effluent stream from the first contacting zone comprising upgraded materials, uncoverted heavy oil, solvating medium, along with slurry catalyst flow to the next separation zone in series for separation of gas and volatile liquids from the non-volatile fractions. The gaseous and volatile liquid fractions including the solvating medium are withdrawn from the top of the separation zone and sent away for solvent removal, purification in a lean contactor (not shown), or for further processing or blending, e.g., for final blended products meeting specifications designated by refineries and/or transportation carriers. The non-volatile (or less volatile) stream is withdrawn from the bottom and sent to the next contacting zone in series for further heavy oil upgrade with additional $H_2$ containing gas, additional solvating medium, optional heavy oil feed, additional hydrocarbons, fresh catalyst feed.

The effluent stream from the second contacting zone is sent to a second separator for separation of the gas fractions (containing upgraded products and solvating medium) from the non-volatile fractions comprising spent slurry catalyst, unconverted materials, heavier hydrocracked products, small amount of coke and asphaltenes, etc. The gas fractions can be combined with the gaseous and volatile liquid fractions from a preceding separation zone for further processing, e.g., solvent recovery, purification, etc. The non-volatile fractions are collected and sent to a solvent deasphalting unit, a catalyst deoiling unit and subsequently a metal recovery system.

Depending on the operating conditions, the type of catalyst fed into the contacting zone and the concentration of the slurry catalyst, in one embodiment, the outlet stream from the contacting zones comprises a ratio of 20:80 to 60:40 of upgraded products to unconverted heavy oil feed. In one embodiment, the amount of upgraded products out of the first contacting zone is in the range of 30-35% to unconverted heavy oil product of 65-70%.

Figure 3:
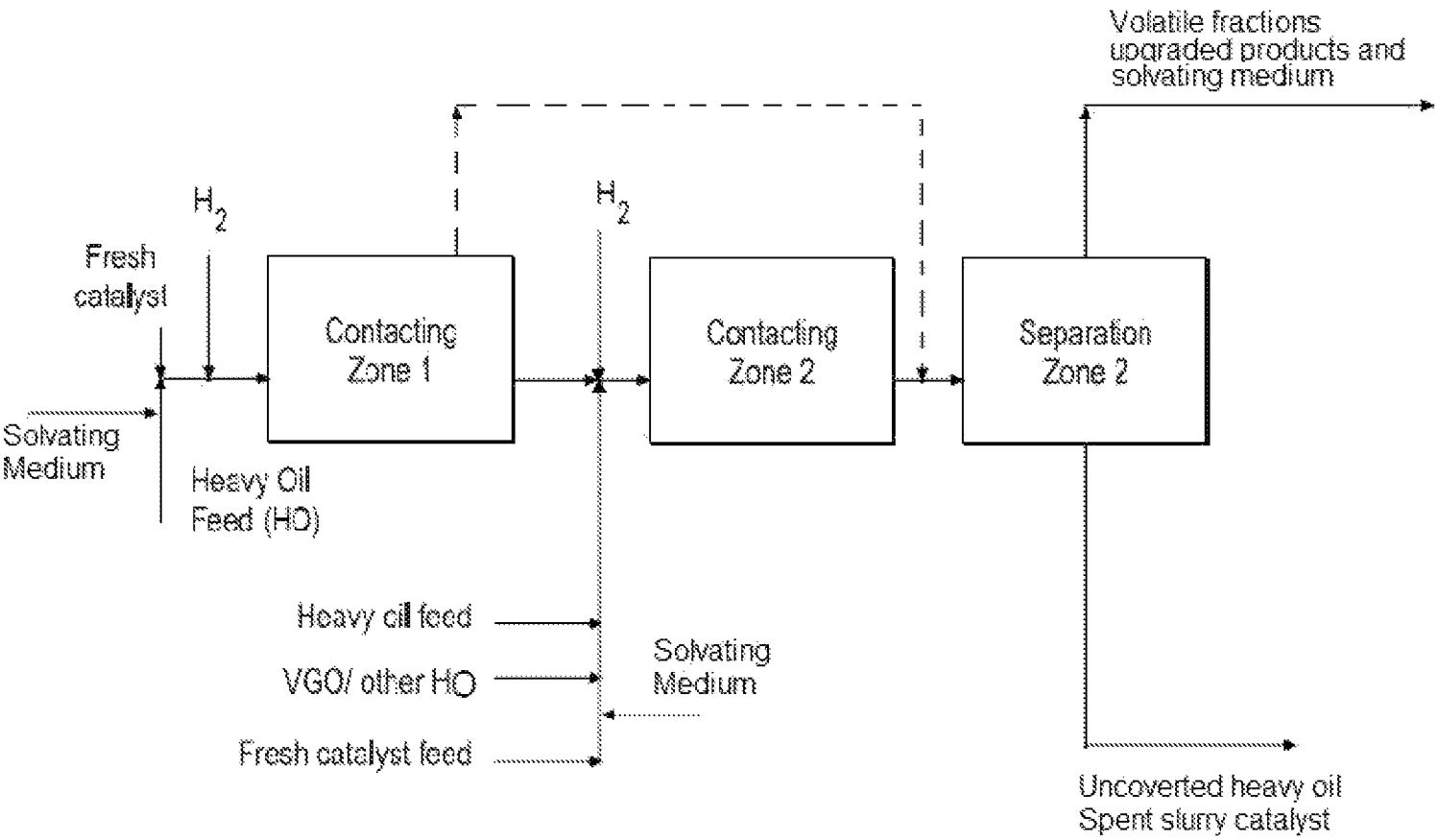

FIG. 3 is a block diagram schematically illustrating another embodiment of a once-through upgrade system under SC conditions with two contacting zones running in series. Effluent from the first reactor (contacting zone) is sent to a second reactor in series for further upgrade, along with additional hydrogen, solvating medium, optional additional heavy oil feed, VGO or other hydrocarbon feed, and optional fresh catalyst feed. In one embodiment (as indicated by dotted lines), the effluent stream from the first reactor is sent to a separator (along with the effluent stream from the second reactor), wherein the gas fractions (containing upgraded products, hydrogen gas, and solvating medium) are separated from the non-volatile fractions comprising spent slurry catalyst, unconverted materials, heavier hydrocracked products, small amount of coke and asphaltenes, etc.

Figure 4:
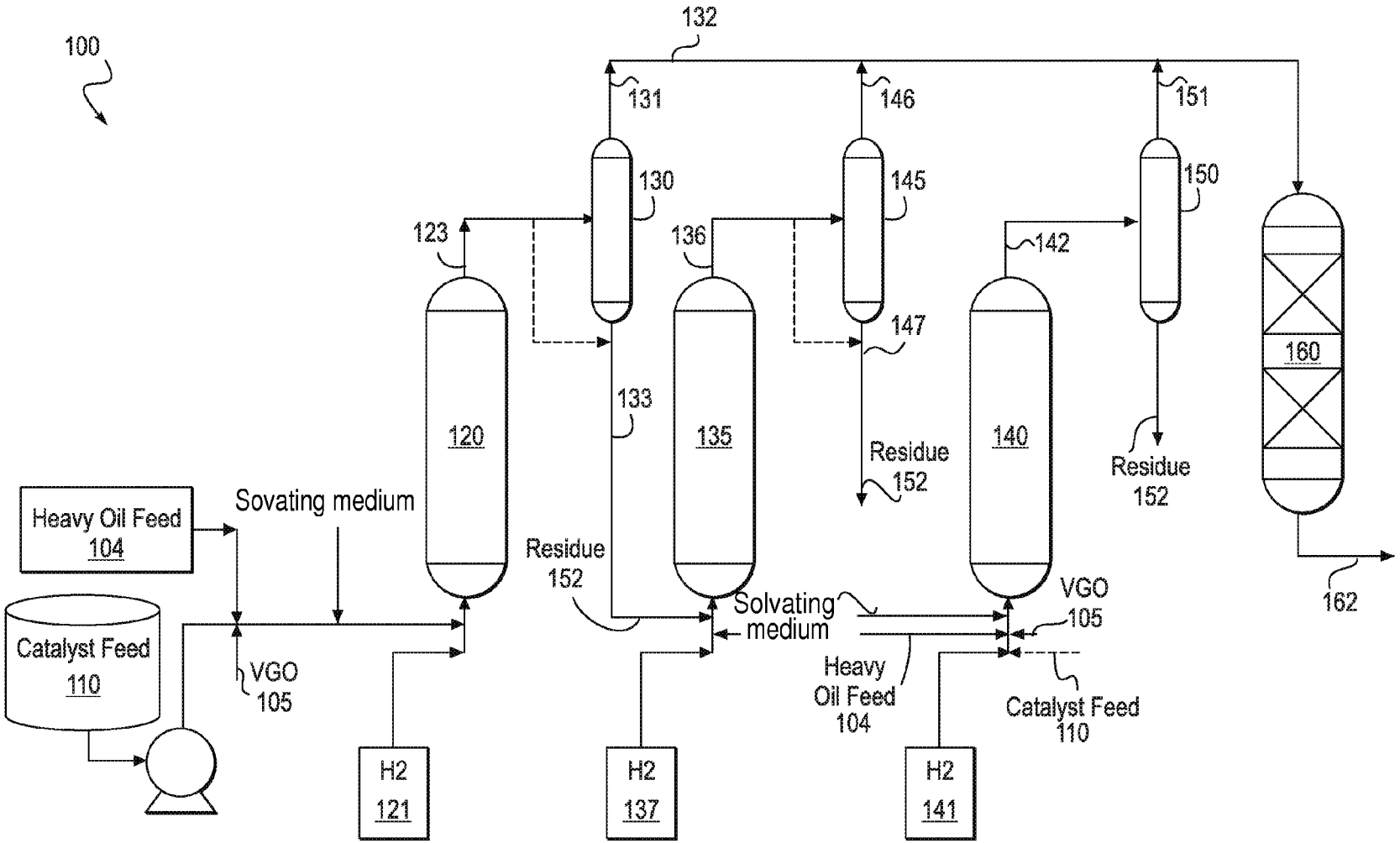
FIG. 4 is a flow diagram of an embodiment of a flexible once-through upgrade process under once-through conditions where the majority of hydrocarbons is at near critical conditions (around critical point), with a plurality of contacting zones and separation zones, and with some of the contacting zones running in sequential mode, with the third reactor running in tandem with separate feed streams.

FIG. 4 illustrates one embodiment of a flexible once-through upgrade process, wherein reactors 120 and 135 are engaged for heavy oil upgrade, and the third reactor system 140 is put on stand-by or back up mode with $H_2$ feed only, or it can be used for the upgrade of heavy oil as shown (employing a different catalyst, a different solvating medium, and/or heavy oil feedstock). The third reactor 140 system can also be shut-down for maintenance while the other two are kept on-line.

As shown, reactors 120 and 135 run in series, with the bottoms liquid stream 133 from the high pressure high temperature (HPHT) separator 130 is sent to reactor 135 for further upgrade. Volatile product streams from the overhead HPHT separators are combined with hot hydrogen 151 from the stand-by unit (or overhead stream with upgraded products if reactor 140 is in operation) and sent to a lean contactor or a downstream purification process. Bottoms stream comprising unconverted heavy oil, spent catalyst slurry, asphaltenes, etc. from the separator, e.g., 147 is collected as residue 152 and sent to a downstream process for deoiling and/or metal recovery in a metal recovery unit.

Although not shown in the figures, the system may optionally comprise recirculating/recycling channels and pumps for promoting the dispersion of reactants, catalyst, and heavy oil feedstock in the contacting zones. In one embodiment, a recirculating pump circulates through the loop reactor a volumetric recirculation ratio of 5:1 to 15:1 (recirculated amount to heavy oil feed ratio), thus maintaining a temperature difference between the reactor feed point to the exit point ranging from 10 to 50° F., and preferably between 20-40° F.

In one embodiment, the system further comprises solvent recovery means wherein the gaseous and volatile liquid fractions from the separation zone(s) enter a distillation column, wherein the solvent is flashed off and subsequently recycled. In another embodiment, the system may optionally comprise a lean contactor for product purification. In yet another embodiment, the system may optionally comprise an in-line hydrotreater (not shown) for treating the gaseous and volatile liquid fractions from the separation zones. The in-line hydrotreater in one embodiment employs conventional hydrotreating catalysts, is operated at a similarly high pressure (within 10 psig in one embodiment, and 50 psig in a second embodiment) as the rest of the upgrade system, and capable of removing sulfur, Ni, V, and other impurities from the upgraded products.

The following examples are given as non-limitative illustration of aspects of the present invention.

EXAMPLES: The following illustrative examples are intended to be non-limiting. Unless specified otherwise, the catalytic activity of the catalysts prepared in the examples are tested for Hydrodenitrogenation (HDN), Hydrodesulfurization (HDS), as well as API gravity change and Microcrystalline Carbon Residue (MCRT). Table 1 lists the properties of the heavy oil feedstock used in the sample.

TABLE 1

| Properties Heavy Oil VR | Value |
|---|---|
| Feed API | 2.5 |
| Feed S.G. | 1.06 |
| Viscosity (100 C.), cst | 14548 |
| Viscosity (130 C.), cst | 1547 |
| Viscosity (150 C.), cst | NA |
| Feed Sulfur, wt % | 5.53 |
| Feed Nitrogen, ppm | 5688 |
| Feed MCR, wt % | 25.4 |
| Feed Vanadium, ppm | 517.7 |
| Feed Nickel, ppm | 102.2 |
| Hot Heptane Asphaltenes, wt % | 16.3 |
| Feed VR (1000 F.+) Content, wt % | 86.4 |
| Feed HVGO (800 F.+) Content, wt % | 97.8 |
| Feed VGO (650 F.+) Content, wt % | 99.6 |
| Feed C, wt % | 83.71 |
| Feed H, wt % | 9.88 |
| H/C Ratio | 0.118 |

The solvating medium (solvent) was a toluene/methylcyclohexane mixture at a rate of 4/1 ratio of solvent to VR. The experiments were carried out in a batch reactor at 785° F. and 825° F. For both temperatures, the solids build-up on the catalyst was significantly lower for the runs employing the solvating medium ("dense phase" or "dense fluid"). At the higher temperatures, conversions were higher than for the cases not employing solvating medium. This may be due to a lower deactivation of the catalytic material when a solvating medium is present. A number of experiments were run to evaluate the use of dense fluid for upgrading of heavy oil feedstock under supercritical conditions.

HiSYS calculations were carried out for different solvent to VR ratios to determine the dense fluid temperature and pressure. The results are shown in Table 2 (with toluene and methylcyclohexane as solvent). VTB stands for vacuum tower bottom, indicating the heavy oil feedstock to solvent ratio. SOR indicates the ratio of solvent to heavy oil feedstock. Tc and Pc are critical temperature and critical pressure as indicated by the HiSYS model.

TABLE 2

| VTB | Solvent | SOR | $T_c$, ° F. | $P_c$, psia |
|---|---|---|---|---|
| 10 | 90 | 9.0 | 615 | 580 |
| 20 | 80 | 4.0 | 630 | 571 |
| 33 | 67 | 2.0 | 657 | 557 |
| 50 | 50 | 1.0 | 705 | 531 |

TABLE 2-continued

| VTB | Solvent | SOR | $T_c$, ° F. | $P_c$, psia |
|---|---|---|---|---|
| 75 | 25 | 0.3 | 855 | 450 |
| 100 | 0 | 0.0 | 1536 | 84 |

VTB has a $T_c$ of 1586° F. and a $P_c$ of 92 psi. The solvating medium has a $T_c$ of 602° F. and 585 psi. Per HiSYS model, an 80/20 Solvent/VTB mixture has a $T_c$ of 630° F. and a $P_c$ of 571 psi.

Several experiments were run with a heavy oil feedstock VR to solvating medium toluene and methylcyclohexane in a ratio of 2.5/10/1 (VR/toluene/methylcyclohexane). The first set of experiments was carried out at a temperature of 785° F. and with a starting pressure of 900 psi hydrogen. The soak time after reaching reaction temperature (which took 2.5 hours) was 2 hours. After the soak, the reactor was quenched with water and the material was drained. The solids were separated by filtration and the liquid was sent out for analysis to determine refractive index, API gravity, nitrogen content, sulfur content and MCR. Conversions were calculated by using the absolute amounts of nitrogen, sulfur and MCR in the feed and product, as the amount of filtrate varied depending on filtration times (longer filtration leads to more low boiling material evaporation).

For all examples, a fresh slurry catalyst was prepared according to the teaching of US Patent No. 2006/0058174, e.g., a Mo compound was first mixed with aqueous ammonia forming an aqueous Mo compound mixture, sulfided with a sulfur-containing compound, promoted with a Ni compound, then transformed in a hydrocarbon oil, e.g., VGO, at a temperature of at least 350° F. and a pressure of at least 200 psig, forming an active slurry catalyst with about ~5% wt. % Mo/hydrocarbon oil, and a Ni/Mo ratio of about 10 wt. %.

For some of the examples, the active slurry catalyst was further diluted with toluene (~200g of slurry catalyst with ~500 ml of toluene) and then centrifuged. The supernatant was decanted and the pasty material left behind was used for the examples (indicted as "TES" or toluene extracted solids) for a Mo content of ~22wt %.

The results of the runs with a solvating medium are shown in Table 3 below.

TABLE 3

| Example | TES/Slurry Catalyst (Mo/VR ratio) | Solids (g) | N conv. % | S conv. % | MCR conv. % |
|---|---|---|---|---|---|
| 1 | 5.1% (slurry) | 2.6 | 42.5 | 83.8 | 79.8 |
| 2 | 4.6% (TES) | 2.6 | 47.7 | 88.7 | 79.7 |
| 3 | 1.5% (TES) | 0.70 | 40.0 | 77.2 | 64.0 |
| 4 | 0.8% (TES) | 0.30 | 42.7 | 65.5 | 65.8 |

There is a difference in the removal of nitrogen and sulfur removal for the runs with slurry and TES. The lower conversion of the first experiment, i.e., using a slurry catalyst instead of TES shows the effect of dilution by VGO from the slurry catalyst. However, the MCR removal stays the same. Catalyst concentration seems to show an effect at 4.6% vs. 0.8 and 1.5% for nitrogen and MCR removal. For sulfur removal, there was an increase going from 0.8% to 1.5% molybdenum to VR ratio. Overall, there is a small correlation between catalyst concentration and conversion rate.

The next set of experiments were for heavy oil conversion process without the use of a solvating medium, e.g., experiments with 5.0% of slurry catalyst and 4.6% of TES catalyst. Results are shown in Table 4:

TABLE 4

| Comparative Example | TES/Slurry Cat (Mo/VR ratio) | Solids (g) | N conv. % | S conv. % | MCR conv. % |
|---|---|---|---|---|---|
| 5 | 5.0% (slurry) | 11.6 | 70.6 | 92.2 | 81.8 |
| 6 | 4.5% (TES) | 11.5 | 72.6 | 92.6 | 82.4 |

In examples 5-6, the amount of heavy oil feed stock was 2.7 times higher than the amount of heavy oil feedstock used in Examples 1-4. The operating pressure for examples 5-6 was 1700-1800 psi compared to 900 psi for Examples 1-4. Also for Examples 1-4, the ratio of hydrogen to heavy oil feed stock was higher by a factor of 2. The solids amount was lower with Examples 1-4, even when taking into account the 2.7 times higher initial amount of catalyst (which would give an amount of 7g solids). If the amount of pure $MoS_2$ and NiS is calculated from the solids analysis of the fresh catalyst, 2.3 g should be recovered for Examples 1-4 and 6.2 g for Examples 5-6. This suggests that reactions under supercritical conditions can lead to less solids build-up on the catalyst itself. 25 g of heavy oil feed stock are diluted with 110 g of solvent in Examples 1-4, while 67.5 g of heavy oil feed stock are diluted with 45 g of cycle oil in Examples 5-6. This could explain the lower conversion of nitrogen, which is a sensitive reaction to catalyst activity (concentration). At lower temperatures, coking reactions that deactivate the catalyst are relatively slow. Therefore, an advantage of supercritical reaction media due to decreased deactivation of the catalyst would not be easily detected at lower temperatures.

Examples 7-12 were conducted to test higher temperature reactions (increased coking reactions) with different amounts of catalyst: TES (toluene extracted solids) and slurry catalyst. All experiments were conducted at 825° F. Examples 7-9 were with toluene and methylcyclohexane in a ratio of 2.5/10/1 (VR/toluene/methylcyclohexane) as a solvating medium. Examples 10-12 were with a slurry catalyst and without the solvating medium. As in the case of the low temperature experiments, the hydrogen to VR ratio was by a factor of 1.4 higher for Examples 7-9. The results are shown in Table 5 below.

TABLE 5

| Example | Cat (Mo/VR ratio) | Solids (g) | N conv. % | S conv. % | MCR conv. % | 1000° F. + conv. % | 800° F. + conv. % | 650° F. + conv. % |
|---|---|---|---|---|---|---|---|---|
| 7 | 4.2% (TES) | 3.1 | 47.9 | 81.2 | 73.9 | 91.9 | 76.3 | 59.8 |
| 8 | 2.1% (TES) | 1.8 | 41.1 | 79.3 | 64.5 | 90.1 | 74.7 | 59.3 |
| 9 | 1.1% (TES) | 1.4 | 40.7 | 80.9 | 68.7 | 94.9 | 85.0 | 71.3 |
| 10 | 1.1% (slurry) | 3.4 | 44.3 | 80.9 | 68.7 | 87.9 | 70.9 | 52.1 |
| 11 | 1.1% (slurry) | 3.0 | 48.8 | 81.3 | 69.5 | 80.2 | 67.3 | 51.8 |
| 12 | 1.1% (slurry) | 3.5 | 43.2 | 80.0 | 66.3 | 82.0 | 67.4 | 50.0 |

Solids build-up was higher for Examples 10-12 as compared to Examples 7-9 with the solvating medium under supercritical conditions. As the build-up of solids on the catalyst is suppressed, the use of solvating medium under supercritical conditions would lead to a less deactivated catalyst system.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A process for hydroprocessing a heavy oil feedstock, the process employing a plurality of contacting zones and at least a separation zone, the process comprising:

providing a hydrogen containing gas feed;

providing a feed mixture comprising a heavy oil feedstock with a solvating hydrocarbon having a normal boiling point less than 538° C. (1000° F.) at a weight ratio of the solvating hydrocarbon to the heavy oil feedstock is in the range of 1:1 to 20:1, the solvating hydrocarbon comprising a mixture of toluene and methyl cyclohexane (MCH) in a ratio ranging from 10:1 to 1:10 of toluene to MCH, and the feed mixture having a critical pressure $P_c$ in the range of 500 to 2000 psi and a critical temperature $T_c$ in the range of 500 to 1000° F.;

providing a slurry catalyst feed in a hydrocarbon oil diluent;

combining the hydrogen containing gas feed, the mixture of heavy oil feedstock and the solvating hydrocarbon, and the slurry catalyst feed in a first contacting zone at a temperature near $T_c$ and a pressure near $P_c$ to convert at least a portion of the heavy oil feedstock to lower boiling hydrocarbons, forming upgraded products;

sending a first effluent stream from the first contacting zone comprising the upgraded products, the slurry catalyst, the hydrogen containing gas, the solvating hydrocarbon, and unconverted heavy oil feedstock to a first separation zone, wherein volatile upgraded products are removed with the hydrogen containing gas as a first overhead stream, and the slurry catalyst and unconverted heavy oil feedstock are removed as a first non-volatile stream;

collecting the first overhead stream for further processing; and collecting the first non-volatile stream for further processing.

2. The process of claim 1, wherein the plurality of contacting zones operate in a parallel mode, and the process further comprising:

providing to a second contacting zone, operated at a temperature near $T_c$ and a pressure near $P_c$, at least a portion of hydrogen containing gas feed, at least a portion of the mixure of heavy oil feedstock and solvating hydrocarbon, and at least a portion of the slurry catalyst feed;

combining the at least a portion of hydrogen containing gas feed, the at least a portion of the mixure of heavy oil feedstock and solvating hydrocarbon, and the at least a portion of the slurry catalyst feed in the second contacting zone to convert at least a portion of the heavy oil feedstock to lower boiling hydrocarbons, forming additional upgraded products;

sending the first effluent stream and a second effluent stream from the second contacting zone comprising the additional upgraded products, the slurry catalyst, the hydrogen containing gas, the solvating hydrocarbon, and unconverted heavy oil feedstock to the first separation zone, wherein the first overhead stream and the first non-volatile stream are removed for further processing.

3. The process of claim 2, wherein the slurry catalyst feed to the second contacting zone is a different slurry catalyst from the slurry catalyst feed to the first contacting zone.

4. The process of 1, further comprising:

adding an additional hydrocarbon oil feed to the first contacting zone, in an amount ranging from 2 to 40 wt. % of the heavy oil feedstock.

5. The process of claim 4, wherein the additional hydrocarbon oil feed is selected from vacuum gas oil, naphtha, medium cycle oil, light cycle oil, heavy cycle oil, solvent donor, and aromatic solvents.

6. The process of 1, for treating a heavy oil feedstock having a TAN of at least 0.1; a viscosity of at least 10 cSt; an API gravity at most 15; at least 0.0001 grams of Ni/V/Fe; at least 0.005 grams of heteroatoms; at least 0.01 grams of residue; at least 0.04 grams C5 asphaltenes; and at least 0.002 grams of MCR per gram of heavy oil feedstock.

7. The process of 1, wherein the slurry catalyst feed has an average particle size of at least 1 micron.

8. The process of 1, wherein the slurry catalyst feed has an average particle size ranging from 1 to 20 microns.

9. The process of 1, wherein the slurry catalyst feed comprises clusters of colloidal sized particles of less than 100 nm in size.

10. The process of 1, wherein the slurry catalyst feed comprises an active metal catalyst at a concentration of greater than 1000 wppm of active metal catalyst to heavy oil feedstock.

11. The process of 1, further comprising providing at least an additive for trapping metals in the heavy oil feed and coke, the additive having a BET surface area of at least 1 $m^2/g$ and a total pore volume of at least 0.005 $cm^3/g$.

12. The process of claim 11, wherein the additive comprises carbon black having an average particle size ranging from 1 to 100 microns.

13. The process of 1, wherein a sufficient amount of a hydrogen containing gas feed is provided for the process to have a volume yield of at least 115% in upgraded products comprising liquefied petroleum gas, gasoline, diesel, vacuum gas oil, and jet and fuel oils.

14. The process of 1, for treating a heavy oil feedstock having a TAN of at least 0.1; a viscosity of at least 10 cSt; an API gravity at most 15;at least 0.0001 grams of Ni/V/Fe; at least 0.005 grams of heteroatoms; at least 0.01 grams of residue; at least 0.04 grams C5 asphaltenes; and at least 0.002 grams of MCR.

15. A process for hydroprocessing a heavy oil feedstock, the process employing a plurality of contacting zones and separation zones, including a first contacting zone and a contacting zone other than the first contacting zone, the process comprising:

providing a hydrogen containing gas feed;

providing a feed mixture comprising a heavy oil feedstock with a solvating hydrocarbon having a normal boiling point less than 538° C. (1000° F.) at a weight ratio of the solvating hydrocarbon to the heavy oil feedstock of at least 1:1, the feed mixture having a critical pressure $P_c$ and a critical temperature $T_c$;

providing a slurry catalyst feed having in a hydrocarbon oil diluent;

combining the hydrogen containing gas feed, the mixture of heavy oil feedstock and the solvating hydrocarbon, the slurry catalyst feed in a first contacting zone at a temperature near $T_c$ and a pressure near $P_c$ to convert at least a portion of the heavy oil feedstock to lower boiling hydrocarbons, forming upgraded products;

sending a mixture comprising the upgraded products, the slurry catalyst, the hydrogen containing gas, the solvating hydrocarbon, and unconverted heavy oil feedstock to a first separation zone, wherein volatile upgraded products are removed with the hydrogen containing gas and the solvating hydrocarbon from the first separation zone as a first overhead stream, and the slurry catalyst, heavier hydrocracked liquid products, and the unconverted heavy oil feedstock are removed from the first separation zone as a first non-volatile stream, and;

sending the first non-volatile stream to a contacting zone other than the first contacting zone with additional hydrogen containing gas feed, which contacting zone is maintained at a temperature near $T_c$ and a pressure near $P_c$ to convert at least a portion of the unconverted heavy oil feedstock to lower boiling hydrocarbons, forming additional upgraded products;

sending a mixture comprising the additional upgraded products, the slurry catalyst, the additional hydrogen containing gas, the solvating hydrocarbon, and unconverted heavy oil feedstock to a separation zone other than the first separation zone, whereby additional volatile upgraded products are removed with the additional hydrogen containing gas and the solvating hydrocarbon as an overhead stream, and the slurry catalyst and the unconverted heavy oil feedstock are removed as a second non-volatile stream.

16. The process of claim 15, wherein at least a portion of the second non-volatile stream is recycled to the first contacting zone for use as part of the slurry catalyst feed, and remainder of the second non-volatile stream is removed from the process as a bleed-off stream in an amount sufficient for the process to have a conversion rate of at least 90%.

17. The process of claim 15, wherein a fresh slurry catalyst is fed into a contacting zone other than the first contacting with the additional hydrogen containing gas feed.

* * * * *